US005928429A

United States Patent [19]

Duncan et al.

[11] Patent Number: 5,928,429

[45] Date of Patent: Jul. 27, 1999

[54] PROCESS FOR THE ENHANCEMENT OF RECOVERY OF SUGAR

[75] Inventors: David Mack Duncan; Gene Richard Allen, both of Hereford, Tex.

[73] Assignee: Imperial Holly Corporation, Sugar Land, Tex.

[21] Appl. No.: 08/961,906

[22] Filed: Oct. 31, 1997

[51] Int. Cl.[6] ..... C13D 3/14; C13D 3/02; C13D 3/06; C13D 1/08

[52] U.S. Cl. ..... 127/48; 127/46.3

[58] Field of Search ..... 127/46.3, 48

[56] References Cited

U.S. PATENT DOCUMENTS

| | | | |
|---|---|---|---|
| 2,977,253 | 3/1961 | Grandadam | 127/48 |
| 3,734,773 | 5/1973 | Haley | 127/48 |

*Primary Examiner*—David Brunsman
*Attorney, Agent, or Firm*—Locke Liddell & Sapp LLP

[57] ABSTRACT

This invention relates to the coprocessing of raw sugar and molasses ion exclusion product, optionally with added sugar beet diffusion juice, to enhance the recovery of sugar. In a preferred method, raw cane sugar is melted in limed water, prior to its addition to ion excluded juice.

20 Claims, 1 Drawing Sheet

PROCESS FOR THE ENHANCEMENT OF RECOVERY OF SUGAR

FIELD OF THE INVENTION

This invention relates to the coprocessing of raw cane sugar and molasses ion excluded product, optionally with added sugar beet diffusion juice, to enhance the recovery of sugar.

BACKGROUND OF THE INVENTION

The manufacture of sugar from sugar beets generally occurs in five stages: (1) diffusion, (2) juice purification, (3) evaporation, (4) crystallization, and (5) recovery of sugar from molasses.

The composition of sugar beets is dependent on the genetic strain, soil and fertilization factors, weather conditions during growth, incidence of plant disease, degree of maturity and the treatment between harvesting and processing. Typically, the percentage of sugar in mature beets ranges from about ten to about twenty-two percent with about ten to about sixteen percent being the medium values. A mature beet generally contains about three-quarters water. The beet has a liquid or juice phase and an insoluble or solid phase. The juice contains approximately 25 percent by weight of dissolved solids, the largest component of which is sucrose.

Sucrose, as well as other water soluble constituents, are diffused from sugar beets by a countercurrent process in which the sugar beets, sliced into thin strips called cossettes, enter one end of the diffuser while warm water enters the other. In this manner, about 98 percent of the sucrose in the sugar beet is removed along with a considerable portion of other water soluble components as well as colloidal and cell wall particles. This sugar laden juice is called "diffusion juice."

The nature and amount of the non-sucrose components in the diffusion juice greatly determines the amount of sugar that can be recovered by the crystallization portion of the process. Sugar not recovered by crystallization becomes a part of molasses, a by-product of lesser value. Molasses is marketed as an animal feed or fermentation process feed. Alternatively, it can be employed in the ion exclusion process to recover a portion of the sucrose.

Since the late 1800's, the classical process for purifying diffusion juice has been by a lime-carbon dioxide purification process. This process includes the steps of: (1) preliming or pre-defecation, (2) main-liming, (3) first carbonation, (4) solids separation and (5) second carbonation.

The purpose of preliming is to alkalize the juice to stabilize the colloidal and particulate material therein and to precipitate certain of the non-sugars. Such non-sugars include acid anion groups of relatively insoluble lime salts such as phosphate, sulfate and certain of the organic acids, proteins, and their moieties and colloidal substances which are not adequately removed in main-liming. In main liming, additional amounts of liming agent are supplied to the prelimed juice to increase the pH. During main liming, invert sugar (glucose and fructose) are destroyed and amides (glutamine and asparagine) are saponified.

After main liming, the first carbonation proceeds. In first carbonation, carbon dioxide gas is reacted with the main limed juice to precipitate added lime as calcium carbonate and bring the alkalinity of the juice to a desired low level of about 0.1 weight percent liming agent. Additional purification is accomplished when non-sugars precipitated in main liming are occluded within the growing calcium carbonate crystal or adsorbed on the crystal surface. It is further necessary at this time to remove precipitated calcium carbonate, called "carbonation mud", in order that the precipitated non-sugars do not dissolve and reenter the purified sugar solution during the second carbonation stage.

Carbonation mud separation is generally accomplished in two steps. In the first step, the carbonated juice enters a settler where the carbonation mud settles to the bottom. The supernatant is decanted to the second carbonation chamber. The settled carbonation mud is filtered to remove the carbonated juice from the mud particles. The filtrate is then returned to the first carbonation chamber or is used as a carrier for the liming agent.

In the second carbonation chamber, juice is again reacted with carbon dioxide gas to remove as much remaining lime as possible. Juice alkalinity is reduced to about 0.01 weight percent liming agent. A second carbonation juice is then filtered to remove calcium carbonate precipitate. The second carbonation filtrate may be treated with a sulfur dioxide source to inhibit color increase by the Maillard reactions.

SUMMARY OF THE INVENTION

The invention consists of the addition of raw cane sugar to ion exclusion juice which may further be combined with diffusion juice prior to the sugar beet purification prior to or during the step called carbonation. In the case when diffusion juice is present, diffusion juice, ion exclusion juice and raw cane sugar are blended together before carbonation. The overall amount of pure sugar recovered using the process of the invention is significantly higher than that evidenced by the methods in the prior art.

DETAILED DESCRIPTION OF PREFERRED EMBODIMENTS

Figure 1:
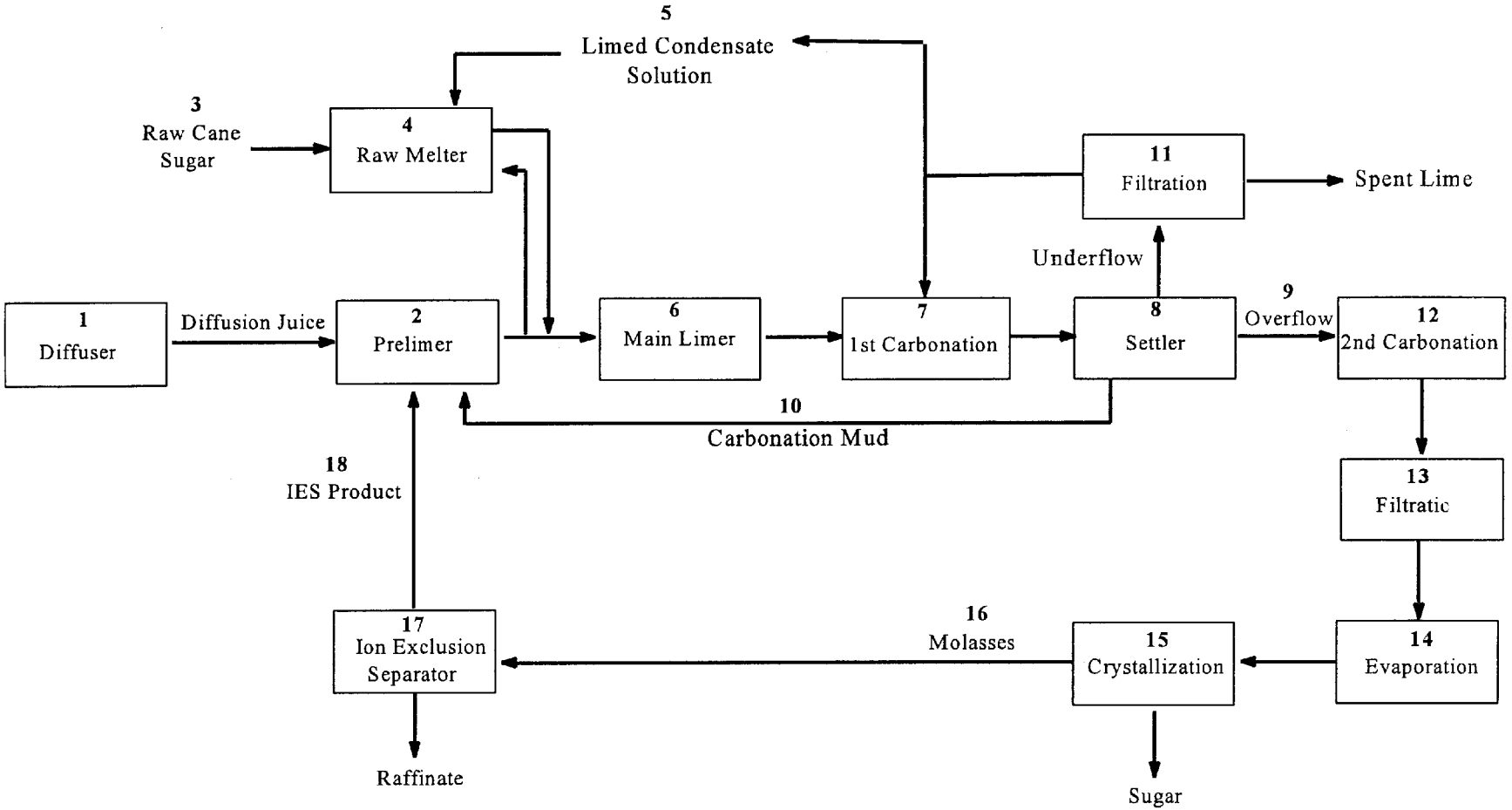
FIG. 1 is a schematic flow diagram of a preferred embodiment of the invention.

The invention is directed to a method of maximizing the production of sugar by introducing raw sugar into the process before the mainlimer. Prelimed juice serves as the carrier in which raw sugar is dissolved and added to the process. When so processed, the rate of sugar production increases by a factor of from about 1 percent to about 2 percent. The invention is further directed to the enhancement of sugar recovery by the addition of ion exclusion juice from the separation of non-sugars in molasses. The invention may be practiced concurrently with the coprocessing of diffusion juice.

As set forth in FIG. 1, when diffusion juice is included in the invention, sliced sugar beets (cossettes) enter diffuser 1 where sugar is extracted by the process of counter-current diffusion. The aqueous solution exiting the diffuser, called "diffusion juice", contains dissolved sugar and other dissolved and colloidal materials injurious to the recovery of sugar.

The diffusion juice is generally cloudy and exhibits a gray color which changes to a dark gray or almost black hue on contact with air. The diffusion juice normally has a pH of between about 6.0 to about 6.5. Typically, it leaves the diffuser at a temperature between about 30° to about 75° C. The non-sucrose content of the diffusion juice is related to the quality of the beets and the conditions under which the sugar is extracted in the factory.

In addition to water and sucrose, diffusion juice contains dissolved impurities and solid impurities which are particulate or colloidal in nature. The colloidal and particulate material make it difficult to concentrate the diffusion juice or to crystallize pure sucrose from the juice. The invert sugars (glucose and fructose) in the juice normally ranges from about 0.4 to about 0.8 weight percent of the dissolved solids. (Unless indicated to the contrary, percentages recited herein shall refer to weight percentages.)

The amount of such unwanted materials (or impurities) present in the juice can be reduced by a purification process in which lime and carbon dioxide gas are employed. The chief objective of juice purification is to efficiently remove the impurities from the juice so that a high quality white sugar can subsequently be formed with a minimum of sugar loss in the molasses or in the impurities removed.

The purification process consists of a number of steps, usually including preliming, main liming, first carbonation and second carbonation and often, solids separation after preliming, first carbonation and second carbonation.

Prior to preliming, the diffusion juice may be screened to remove suspended large particles and then heated to an elevated temperature, typically not greater than 85° C.

In the preliming stage, the diffusion juice exiting diffuser 1 is directed into prelimer 2. Carbonation mud (mostly calcium carbonate) and lime, in the form of an aqueous suspension or slurry of alkaline earth oxides and hydroxides, is added. Preferred preliming (liming) agents are a slurry of calcium oxide and calcium hydroxide known as milk of lime or saccharate milk, a lime-sucrose product. The preliming agent alkalizes the diffusion juice, minimizes the formation of inverted sucrose and stabilizes the colloids without precipitating the organic acids. The addition of the preliming agent raises the pH above 6.5, ultimately to a final value of about 11.2 to about 11.8. The temperature in prelimer 2 is maintained at from about 30° C. to about 85° C.

Preliming is typically accomplished by the addition of about 0.2 to about 0.3 weight percent of liming agent per total weight of the juice. Proteins in the diffusion juice form a colloidal, slimy precipitate which settle slowly and are rather difficult to filter. Furthermore, the proteins depress the activity of the calcium ion and increase the solubility product of the precipitate during carbonation. Preliming provides for the effective coagulation of proteins.

The precipitate produced in preliming includes both ionic and colloidal types. The first ionic reaction of lime is the neutralization of acidity. Since the solubility of the formed lime salts are rather low, large amounts of lime are not required.

From the prelimer the juice may be heated to raise the temperature of the juice to a temperature of about 85° C. to denature the soluble protein and decrease protein solubility in solution. The temperature may vary depending upon the juice quality. Thus, a significant amount of unwanted materials such as proteins, pectins and acids (organic and inorganic) may be removed. Where desired, these precipitated solids can be separated out and the clear juice may continue to the next purification step or may remain with the juice and continue to the next purification step.

The improvement of the invention is the coprocessing of raw cane sugar, ion exclusion juice, and optionally diffusion juice. Raw cane sugar 3 may be dissolved in melter 4 with the addition of a portion of the prelimed juice. The melted raw sugar can be directed to the prelimer or added before the prelimer or added to the prelimed juice exiting the prelimer.

In another embodiment of the invention, the raw sugar may be melted in a blend of prelimed beet juice and ion excluded juice 18. As illustrated in FIG. 1, raw sugar, optimally with juice from the ion exclusion system, may be added to the process in prelimer 2 or added to the prelimed juice exiting prelimer 2. In yet another embodiment of the invention, the raw sugar may be melted in limed water 5 and added to the prelimer or to the prelimed juice.

The amount of requisite liming agent is dramatically reduced by the combined use of raw sugar additive and ion excluded juice. A six-fold decrease in the requisite amount of liming agent has been noted when beet diffusion juice is not present. The weight ratio of raw cane to ion exclusion juice about 5:95 to about 95:5; most preferably from between 40:60 to about 60:40.

The combined flow then enters either main limer 6 or first carbonation tank 7, preferably main limer 6. In main limer 6, additional liming agent is added. The additional liming material may be added in one or two stages. If two stages are used, the first stage is called "cold liming" and is performed at a temperature of about 30° C. to about 70° C. with the addition of the liming material. The second step is called "hot liming" and is performed at a temperature of about 70° C. to about 90° C. with the addition of the liming material. Alternatively, the liming material can be added in a single stage in which the temperature is usually maintained between about 65° and about 85° C. In either implementation, sufficient lime is added to raise the pH value in the main limed juice to about 12.6.

Typically, the total amount of liming material added to main limer 6 is between about 0.1 percent to about 5 percent by total weight of the resultant juice. At high pH, many of the unwanted materials, such as the organic acids or a portion thereof that are relatively insoluble in the limed solution precipitate out or decompose. In particular, the process causes the decomposition of materials, such as invert sugars, harmful to subsequent process steps.

Main limed juice may then be directed to first carbonation 7 where additional liming agent may be added and $CO_2$ gas is bubbled through the solution. The pH in tank 7 is typically between about 10.8 to about 11.3. The temperature is generally between about 80° C. to about 90° C. In tank 7, the additional liming agent when reacted with $CO_2$ gas forms sufficient calcium carbonate to act as a filter aid in subsequent filtration step 11 and provides a large surface area on which non-sugars may be adsorbed. Additionally, as the precipitate forms, it traps or occludes the adsorbed substances within the growing crystal, thereby providing a fresh surface for additional adsorption and producing a crystal firm enough to act as a filter for a subsequent filtration step.

The precipitate from first carbonation, called "carbonation mud", must be removed from the juice before entering second carbonation. If it is not removed the additional $CO_2$ gas provided in second carbonation 12 may solubilize the non-sugars precipitated or adsorbed in first carbonation. The carbonation mud is removed in two stages. In the first stage, the mud is settled out in a settling device 8 and the clear juice above the settled mud, called overflow 9, is decanted. The settled carbonation mud 10 is then filtered such that the filtrate may be directed to first carbonation 7 or used as a carrier for the liming agent in prelimer 2.

In second carbonation, the decanted juice is reacted with $CO_2$ gas. The main objective is to remove from the juice as much of the remaining lime as possible. The reaction with $CO_2$ gas produces calcium carbonate and calcium bicarbonate. Generally, the pH in second carbonation is between about 8.8 to about 9.4. The temperature is about 85° C. to about 95° C. A small amount of liming agent can be added to the combined juice before second carbonation to enhance purification. The precipitate formed in second carbonation is removed from the juice in filter 13.

By use of the combination of raw sugar addition and ion excluded juice a dramatic decrease in color is seen when compared to processing ion excluded juice alone.

A small amount of sulfur dioxide (usually about 50–300 ppm) may be added to the filtrate to prevent color formation by the Maillard reaction in the following evaporation step. The filtrate is purified juice, referred to as "thin juice".

The thin juice is then concentrated in evaporator 14. Typically, the thin juice is heated to a temperature sufficient to concentrate the juice. Generally, the percentage of dissolved solids in the juice is raised from about 10 to 15 percent to about 50 to 65 percent. The pH of the juice holds relatively constant during the evaporation.

Multiple-effect evaporators (shown as evaporator 14) are usually used having five individual bodies or "effects." In such evaporators steam used for supplying heat to the first effect is externally drawn. For each succeeding effect, the steam used is that formed in the preceding effect by evaporation of water from the juice. The outflow from the last evaporator effect is called the "thick juice."

The thick juice is then fed to the crystallization station 15 where the sucrose is crystallized from the concentrated solution by a process known in the art.

Typically, the crystallization station comprises:

A. Vacuum pans. This is where crystallization occurs. The concentrated liquid is boiled at low temperature to avoid inversion and caramelization of sucrose. A three boiling system is used in which syrup separated from the sugar crystals formed in a vacuum pan is again crystallized in a subsequent vacuum pan to produce another crop of sugar crystals.

B. Crystallizers. Here, the discharge from the third vacuum pan boiling, called massecuite, is allowed to sit for from about 8 hours to about 48 hours for additional crystallization to occur.

C. Centrifugals. Here, the discharge from the vacuum pans or the crystallizers is spun in a perforated basket which rotates at high speeds. The sucrose crystals are retained on the basket and the syrup portion spun off and collected in a surrounding shell. The retained sugar is washed with hot water in the spinning centrifugal and discharged as white sugar or as an intermediate sugar for recrystallization.

D. Driers. Here, the white sugar is dried in a rotating drum. The drum picks the sugar up by means of internally attached baffles and allow it to fall through a current of dry, filtered air. Or, a device in which a current of dry, filtered air is passed through a bed of sugar.

E. Coolers. In the coolers, cool, conditioned air passes through the sugar in a manner similar to the driers, thus cooling the sugar. By this means the sugar is made ready for sale or storage. Or a bin, termed a conditioning bin, in which cool, conditioned air is pumped up through the sugar.

In the three boiling system, syrup spun off by the centrifugals processing massecuite from third boiling is called "molasses." Molasses is an end product; no additional sugar can be economically crystallized from it. Molasses contains the impurities not removed during the purification process and also a substantial amount of sugar that cannot be removed by further crystallization. The sugar contained in molasses is significant, amounting to between about 8% and 20% of the sugar removed from the sugar beet during diffusion.

The sugar in molasses may typically be separated by an ion exclusion process 17. In this process, molasses is diluted, decalcified by conventional chemical or ion exchange methods, and allowed to circulate through a resin material contained in a column by a simulated moving bed method or by some other method permitting continuous separation. During the chromatographic process, the soluble sugar portion of the molasses advances through the resin material at a slower rate than the majority of soluble impure substances. Thus, in time, the sugar portion and the impurities portion become physically separated. The separation is generally not complete but is sufficient to make the process economically viable. The separated sugar portion, called ion excluded juice, contains about 86 to about 92% purity and about 8 to about 14% unwanted impurities. Most typically, the ion exclusion juice has the following characteristics:

| | Range | Typical |
|---|---|---|
| pH | 9.3–10.2 | 9.6 |
| Color, ICUMSA* | 8000–20000 | 12000 |
| Purity | 86%–92% | 88%–90% |

*ICUMSA, International Commission for Uniform Methods of Sugar Analysis. A method for measuring solution color in which the pH is adjusted to 7.0 +/− 0.1, the solution is passed through a 0.45 micron filter and the absorbance of the solution measured at a wavelength of 420 nm. Color is expressed as percent on dissolved solids.

The ion excluded juice may then be introduced into prelimer 2.

It should be understood that the above described process may be varied to accommodate the needs of a particular installation and to suit local conditions.

What is claimed is:

1. In a process of manufacturing sugar which comprises the steps of subjecting ion excluded juice to either preliming, mainliming, carbonation or any combination of these steps, evaporation of water from the carbonated juice and crystallizing the sugar therefrom, the improvement comprising the addition of raw cane sugar to the ion excluded juice prior to carbonation of the ion excluded juice.

2. The process of claim 1, wherein the raw cane sugar is melted in water, limed water, or any process stream.

3. The process of claim 2, wherein the weight ratio of raw cane sugar:ion excluded juice is between from about 5:95 to about 95:5.

4. The process of claim 3, wherein the weight ratio of raw cane sugar:ion excluded juice is between from about 40:60 to about 60:40.

5. In a process of manufacturing sugar from sugar beets which comprises the steps of producing a sucrose-enriched diffusion juice from cossettes, subjecting the diffusion juice to preliming, mainliming the prelimed juice, carbonation of the mainlimed diffusion juice, evaporation of water from the delimed juice and crystallizing the sugar therefrom, the improvement comprising the addition of an ion excluded juice and raw cane sugar to the diffusion juice prior to mainliming.

6. The process of claim 5, wherein the raw cane sugar is melted prior to its addition to the prelimed diffusion juice.

7. The process of claim 6, wherein the weight ratio of raw cane sugar:ion exclusion juice is between from about 5:95 to about 95:5.

8. The process of claim 7, wherein the weight ratio of raw cane sugar:ion exclusion juice is between from about 40:60 to about 60:40.

9. The process of claim 8, wherein the raw cane sugar is melted in a blend of prelimed diffusion juice and ion exclusion juice.

10. In a process of manufacturing sugar which comprises the steps of subjecting diffusion juice to preliming, mainliming the prelimed diffusion juice, carbonation of the mainlimed diffusion juice, evaporation of water from the mainlimed juice and crystallizing the sugar therefrom, the improvement comprising the addition of raw cane sugar to the diffusion juice prior to mainliming of the prelimed diffusion juice.

11. The process of claim 10, wherein the raw cane sugar is melted prior to its addition to the prelimed diffusion juice.

12. A process of producing sugar from sugar beets which comprises:

a. producing a sucrose-enriched diffusion juice;

b. introducing ion excluded juice and carbonation mud to the sucrose-enriched diffusion juice in a prelimer containing liming agent;

c. introducing raw cane sugar to the sucrose-enriched prelimed diffusion juice;

d. subjecting the product of step (c.) to mainliming;

e. subjecting the product of step (d.) to carbonation and removing the carbonation mud therefrom;

f. concentrating the liquid of the product of step (e.);

g. crystallizing sugar from the concentrated solution of step (f.);

h. subjecting the molasses from step (g.) to ion exclusion and separating the ion excluded juice therefrom; and i. introducing the ion excluded juice into the prelimer.

13. The process of claim 12, wherein the liming agent is an aqueous suspension or slurry of an alkaline earth oxide, hydroxide or carbonate.

14. The process of claim 13, wherein the liming agent is calcium oxide, calcium carbonate or sodium hydroxide.

15. The process of claim 12, wherein the pH of the media prior to step d. is between about 10.8 to about 11.8.

16. The process of claim 12, wherein the pH of the prelimed diffusion juice is about 10.8 to about 11.8.

17. The process of claim 12, wherein the pH of the mainlimed diffusion juice is about 12.6.

18. The process of claim 12, wherein the pH of the mainlimed diffusion juice subjected to carbonation is maintained between from about 10.8 to about 11.3.

19. The process of claim 12, wherein prior to step (f.) the prelimed diffusion juice is subjected to $CO_2$ gas.

20. A process of producing sugar from sugar beets which comprises:

a. producing a sucrose-enriched diffusion juice;

b. introducing carbonation mud to the sucrose-enriched diffusion juice in a prelimer containing liming agent;

c. introducing raw cane sugar to the sucrose-enriched prelimed diffusion juice;

d. subjecting the product of step (c.) to mainliming;

e. subjecting the product of step (d.) to carbonation and removing the carbonation mud therefrom;

f. concentrating the liquid of the product of step (e.); and g. crystallizing sugar from the concentrated solution of step (f.).

* * * * *